US005108584A

United States Patent [19]

Brosseuk

[11] Patent Number: 5,108,584

[45] Date of Patent: Apr. 28, 1992

[54] APPARATUS FOR EXTRATING HEAVY METALS FROM ORE

[76] Inventor: Raymond Brosseuk, 9363 - 156th St., Surrey, Canada, V3R 4LI

[21] Appl. No.: 594,715

[22] Filed: Oct. 9, 1990

[51] Int. Cl.[5] ..... B03B 7/00

[52] U.S. Cl. ..... 209/44; 209/270; 209/296; 209/458; 241/74; 241/79.3

[58] Field of Search ..... 209/3, 12, 13, 44, 270, 209/284, 290, 291, 293, 294, 296, 369, 451, 452, 458; 241/74, 79.3

[56] References Cited

U.S. PATENT DOCUMENTS

| | | | |
|---|---|---|---|
| 652,900 | 7/1900 | Postlethwaite | 209/458 X |
| 1,861,578 | 6/1932 | Munro | 209/270 |
| 2,057,338 | 10/1936 | Malke | 209/452 |
| 3,815,737 | 6/1974 | Katter | 209/44 |
| 4,178,238 | 12/1979 | Harris | 209/270 |
| 4,440,637 | 4/1984 | Smit et al. | 209/369 X |
| 4,525,270 | 6/1985 | McCann | 209/44 |

*Primary Examiner*—Donald T. Hajec
*Assistant Examiner*—Joseph A. Kaufman
*Attorney, Agent, or Firm*—Charles H. Thomas

[57] ABSTRACT

A machine is employed for recovering heavy metals, such as gold, from placer ore. The machine employs a cylindrical, annular outer drum mounted for rotation at an inclination to the horizontal and including at least one spiral vane extending the length of its inner surface. A cylindrical, annular inner barrel is mounted within the drum and has an upper fragmentation section, an intermediate trommel section, and a lower discharge section. A spray of water is directed into the inner barrel and a water spray bar is located in the annulus between the inner barrel and the outer drum. A sluice box is located to receive an input discharge from the upper end of the outer drum. The ore is separated into large tailings that are discharged from the lower end of the inner barrel and fine, light tailings from the outer drum. The heaviest and finest portions of the material are carried by a spiral on the inner surface of the outer drum and discharged into the upper end of the sluice box from the upper end of the outer drum. The sluice box includes a plurality of landings upon which heavy materials, such as gold, collect. The outer drum is subjected to vibration to aid in the recovery process.

34 Claims, 6 Drawing Sheets

APPARATUS FOR EXTRATING HEAVY METALS FROM ORE

BACKGROUND OF THE INVENTION

1. Field of the Invention

The present invention relates to a method and machine for recovering heavy materials, such as gold, from placer ore.

2. Description of the Prior Art

Many different devices have been constructed for the purpose of extracting heavy materials, such as gold and other heavy metals and minerals from placer ore. One very significant problem with conventional gold recovery devices that are used to recover gold from placer ore is that the apparatus employed is unable to separate and recover very fine gold particles from gold bearing ore. As a consequence, much of the gold processed through conventional gold recovery systems is not separated from the ore, but is discarded along with the tailings. More specifically, conventional placer ore gold recovery devices will not recover gold having a particulate size finer than 300 mesh. That is, gold particles that will pass through a mesh screen having more than three hundred openings per inch are totally lost. Furthermore, conventional gold recovery systems discard most of the fine particles of gold having a mesh size in the range of 200 to 300. Naturally, this reduces the efficiency and profitability of conventional placer ore gold recovery operations considerably.

One disadvantage of conventional placer ore gold recovery systems is that as each new load of gravel ore is added to the system, a surge is created in the water flowing through the system. This surging effect carries away many of the fine particles of gold that are originally retained in the system.

A further disadvantage of conventional gold recovery systems involves the very large requirement for water that is necessary for their operation. In conventional gold recovery systems eighteen hundred gallons of water per minute are typically required to process one hundred cubic yards of ore per hour to achieve only marginally acceptable efficiency of separation of gold from the ore. Such vast quantities of water are sometimes unavailable at the sites at which gold bearing placer ore is found.

Furthermore, even where such quantities of water are available, the use of such vast volumes of water in placer recovery operations invariably produces a major environmental impact in the area. Also, as a result of the large volume of water required for operation of conventional placer ore recovery devices and their relatively low efficiency of gold recovery, large holding ponds are necessary to receive tailings, so that the fine particles which merely pass through conventional systems can settle after processing. Failure to provide such holding ponds for conventional gold recovery systems leads to a discharge of fine ore particulates in water, thus significantly adversely affecting the environment and wild life in areas where gold is typically mined.

The efficiency of gold recovery with conventional systems drops rapidly from an initial efficiency of recovery of about 90% during the first three hours of operation to a recovery rate of approximately 60%. Even this reduced efficiency of recovery can be maintained for only about four or five days. Thereafter, the efficiency of recovery drops even further to the point where continued profitability of operation is unacceptable without a complete shutdown of operations and cleaning of the equipment.

A further disadvantage of conventional placer ore gold recovery systems is the extensive time of cleanup that is required. Such systems normally require approximately three hours for cleanup, during which no gold is being recovered. This extensive cleanup time adds significantly to the cost of operations.

Other very significant disadvantages of conventional gold recovery equipment are the great bulkiness, large cost and difficulty in transporting the equipment required For example, several different models of gold recovery plants are manufactured by IHC Holland, a company headquartered in The Netherlands. A typical system of such a conventional IHC device requires three railroad cars or three trucks to transport the component parts of the plant to a ]ob site. Furthermore, the cost of such a plant that will process one hundred cubic yards of ore per hour is in excess of one-half of one million dollars. Moreover, due to the heavy weight and great bulk, such conventional equipment can only be transported to sites having good roads or railway access.

SUMMARY OF THE INVENTION

The present invention is a method and apparatus useful for the recovery of gold and other heavy metals and minerals from placer ore. The invention provides substantial improvements over the deficiencies of prior art systems. Utilizing the method and apparatus of the invention gold particles of 500 mesh are consistently recovered. Indeed, some particles as small as 1300 mesh can be recovered utilizing the system of the invention. The efficiency of recovery of gold from gold bearing ore is consistently on the order of 95%, and does not deteriorate with continued operation, since the system is self-cleaning.

The system of the invention utilizes and reutilizes the same water at different stages in the separation process, so that far less water for operation is required than in conventional placer mining systems. Indeed, to process one hundred cubic yards of placer ore per hour, only three hundred to five hundred gallons of water per minute are required, as contrasted with a requirement for 1800 gallons of water per minute to process the same ore at a lower recovery rate with conventional systems.

The apparatus of the present invention weighs far less than competitive equipment. Even the heaviest model which can process more than one hundred cubic yards of ore per hour weighs approximately 20,000 pounds, which is far less than competitive systems. Moreover, all models of the device are portable and can be towed behind a truck. The device is quite compact and does not represent an oversized highway load, as do conventional systems. Moreover, the smaller models of embodiments of the equipment of the invention can be towed off road, as well as on highways.

The system of the invention does not produce surging when new loads of ore are introduced into the hopper. To the contrary, large gravel fragments are processed in the initial stages of recovery, and are discarded as clean tailings, but with the opportunity of recovering large gold nuggets which are typically discarded in competitive placer recovery systems. The initial stages of separation employed in the system of the invention reduce the amount of solid material that passes completely through all stages of separation from an initial volume down to about 5% of that initial volume for processing in the final stages while maintaining a recovery efficiency of 95%. For example, placer ore loaded into the input hopper of the equipment at the rate of one hundred cubic yards per hour is reduced down to five cubic yards per hour passing through the final sluice stage. Most of the gold which is recovered is concentrated in the smallest 5% of the volume of the ore processed. This gold is typically found as extremely fine particulate matter which can be recovered using the system of the invention.

A further advantage of the system of the invention is the ease of cleanup. The system is essentially self-cleaning, so that the only cleanup required is the recovery of the gold particles from the sluice box mats. This recovery process takes only about fifteen minutes, as contrasted with the three hour cleanup which is required in conventional systems. Furthermore, the equipment of the invention can be rapidly set up, since it is transported as a mobile unit fully assembled on a wheeled chassis. The only set up required is the positioning of the device so that it is properly oriented relative to the horizontal, and the immersion of the water pump intake into the water supply which is required.

In one broad aspect the present invention may be considered to be an apparatus for extracting heavy materials from ore comprising a cylindrical, annular outer drum, a cylindrical, annular inner barrel, a sluice box, a means for directing a spray of water into the inner barrel, a means for supplying a flow of water to the sluice box, and drive means for rotating the inner barrel and the outer drum such that the inner barrel is rotated at a greater speed than that of the outer drum.

The outer drum is mounted for rotation in a disposition inclined relative to the horizontal so as to define upper and lower ends thereof. The outer drum has a radially inwardly extending lip at its lower extremity. The outer drum also has a cylindrical inner surface with at least one spiral vane mounted thereon to extend between said upper and lower ends.

The cylindrical, annular inner barrel or drum includes an upper fragmentation section, an intermediate trommel section, and a lower discharge section. The upper fragmentation section is provided with inwardly directed, longitudinally oriented impact vanes. The intermediate trommel section is delineated from the upper section by an upper inwardly extending annular lip. The lower discharge section is delineated from the trommel section by an inwardly directed intermediate annular lip. The lower discharge section also has an inwardly directed lower annular lip at its lower extremity.

The sluice box is located to receive as an input discharge from the upper end of the outer drum. The spray means for the inner barrel directs a spray of water into the trommel section of the inner barrel while another water supply directs a flow of water to the sluice box. A drive means, typically a gasoline or diesel engine, rotates the outer drum at a first speed so that the spiral vane urges material therein toward the upper end thereof, and also rotates the inner barrel at a second speed that is greater than the first speed.

Preferably a plurality of spiral vanes as aforesaid are provided in the outer drum. All of these vanes have the same pitch and are oriented at equal arcuate displacements relative to each other about the axis of the outer drum. The drum is preferably inclined at an angle of between about two degrees and about fifteen degrees relative to horizontal. The consistency and composition of the ore being processed will govern to some extent the proper angle of inclination of the outer drum relative to horizontal. Typically the drum is inclined at an angle of about eight degrees relative to horizontal.

The outer drum is preferably comprised of a longitudinally extending annular extension with at least one radially directed spiral vane extending inwardly therefrom. This extension is located on the radially extending lip of the outer drum and has a frusto conical configuration.

The trommel section of the inner barrel is provided with a multiplicity of fine perforations at its upper end and a multiplicity of coarse perforations at its lower end. The fine perforations are preferably about one-quarter of an inch in diameter and the coarse perforations are preferably about one and three-quarters inches in diameter. Like the outer drum, the inner barrel is inclined at an angle of between about two degrees and about fifteen degrees relative to horizontal, often at an angle of about eight degrees. The inner barrel is preferably concentrically mounted relative to the outer drum. The drive means rotates the outer drum at a speed of between about one and ten revolutions per minute. The drive means normally rotates the inner barrel at a speed of between about twenty and thirty revolutions per minute.

Both the outer drum and the inner barrel are preferably mounted on a mobile supporting frame, having wheels for ease of movement. The apparatus is thus extremely portable and self contained. Preferably, a vibrating means is interposed between the supporting frame and the outer drum so as to impart vibrations to the outer drum.

The sluice is comprised of a plurality of vertically offset landings, whereby material flowing through the sluice box cascades downwardly from one landing to the landing below. Each landing above the lowermost landing terminates in a lip which overhangs the landing below. When the system is properly operated to recover gold, substantially all of the particles of gold that are 500 mesh and coarser are recovered in the top three landings. The fine particles of gold are not washed any further down the sluice box than this, and can be easily recovered by merely temporarily terminating water flow through the sluice box and extracting the deposited gold particles from the recovery mats.

In another broad aspect the invention may be considered to be a process for separating heavy materials from ore. The process uses an outer hollow cylindrical, annular drum inclined relative to the horizontal to define upper and lower ends and having at least one spiral vane extending inwardly from its inner wall. The drum also includes a radially inwardly extending lip at its lower extremity. A cylindrical, annular barrel is located within the drum and is inclined relative to horizontal. The inner barrel has an upper fragmentation section, an intermediate trommel section, and a lower discharge section. These sections of the inner barrel are delineated from each other by inwardly directed annular lips. The barrel has a radially inwardly extending lip at its lower extremity. A sluice box having upper and lower ends is provided with its upper end located to receive the discharge from the upper end of the outer drum.

According to the process of the invention, the outer drum is rotated at a first speed in a direction such that the spiral vane on the interior wall thereof urges material therein toward the top end of the outer drum and toward the upper end of the sluice box The inner drum is rotated at a second speed that is greater than the first speed Discharge is directed from the upper end of the drum as an input into the upper end of the sluice box, and a spray of water is directed into the trommel section of the inner barrel.

Preferably, the outer drum is rotated at a speed of between about four and eight revolutions per minute and the inner barrel is rotated at a speed of between about twenty four and twenty eight revolutions per minute Preferably also, vibrations are applied to the outer drum and a spray of water is directed onto the inner cylindrical surface of the outer drum To process ore, a flow of water is supplied to the sluice box and ore is fed to the cylindrical inner barrel at a rate of between about one half cubic yards per hour and about three hundred cubic yards per hour A combined flow of water is directed into said outer drum said inner barrel and into the sluice box at a rate less than five hundred gallons of water per minute The invention may be described with greater clarity and particularity with reference to the accompanying drawings.

DESCRIPTION OF THE EMBODIMENT AND IMPLEMENTATION OF THE METHOD

Figure 1:
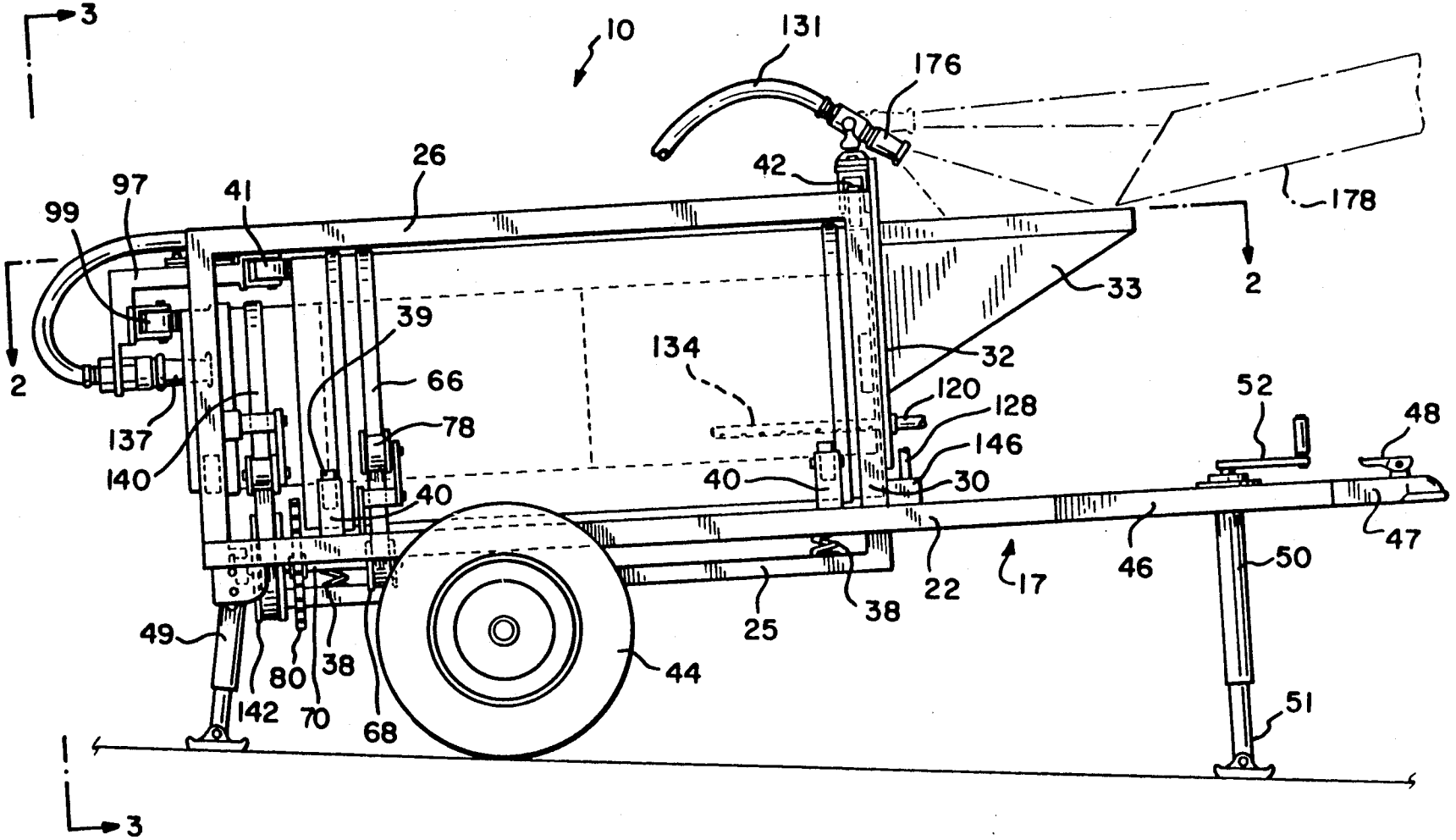
FIG. 1 is a left side elevational view of one embodiment of an apparatus for recovering heavy substances from raw material according to the invention.

FIG. 1 illustrates a portable, mobile placer recovery apparatus 10 for recovering heavy substances from the raw material of placer ore. The placer recovery apparatus 10 is comprised of a sluice box 150, an inner barrel 11 and an outer hollow drum 12 mounted on a mobile supporting chassis 17. When deployed for use the outer drum is inclined relative to horizontal, as indicated by the angle A in FIG. 5. The orientation of the inclined drum 12 thereby defines an upper end 13 and a lower end formed with a radially inwardly directed lip 14.

The Outer Drum 12

The drum 12 is formed with an interior cylindrical wall surface 16 throughout its length between the upper end 13 and the annular lip 14. A pair of spiral vanes 18 and 20 are mounted on the interior wall surface 16 to extend between the lip 14 at the lower end of the drum 12 and the upper end 13 thereof. The vanes 18 and 20 are of a uniform pitch, which may be about ten inches. The vanes 18 and 20 are angularly offset from each other by equal arcuate displacements of 180 degrees and stand about one and one-half inches high, projecting radially inwardly toward the center of the drum from the interior cylindrical wall surface 16 thereof. In one embodiment of the invention the outer drum 12 may be about eight feet in diameter and about twenty four feet in length, although it is to be understood that the sizes of all of the components of the placer recover apparatus 10 may be varied depending upon the rate at which gravel or ore is to be processed.

Figure 5:
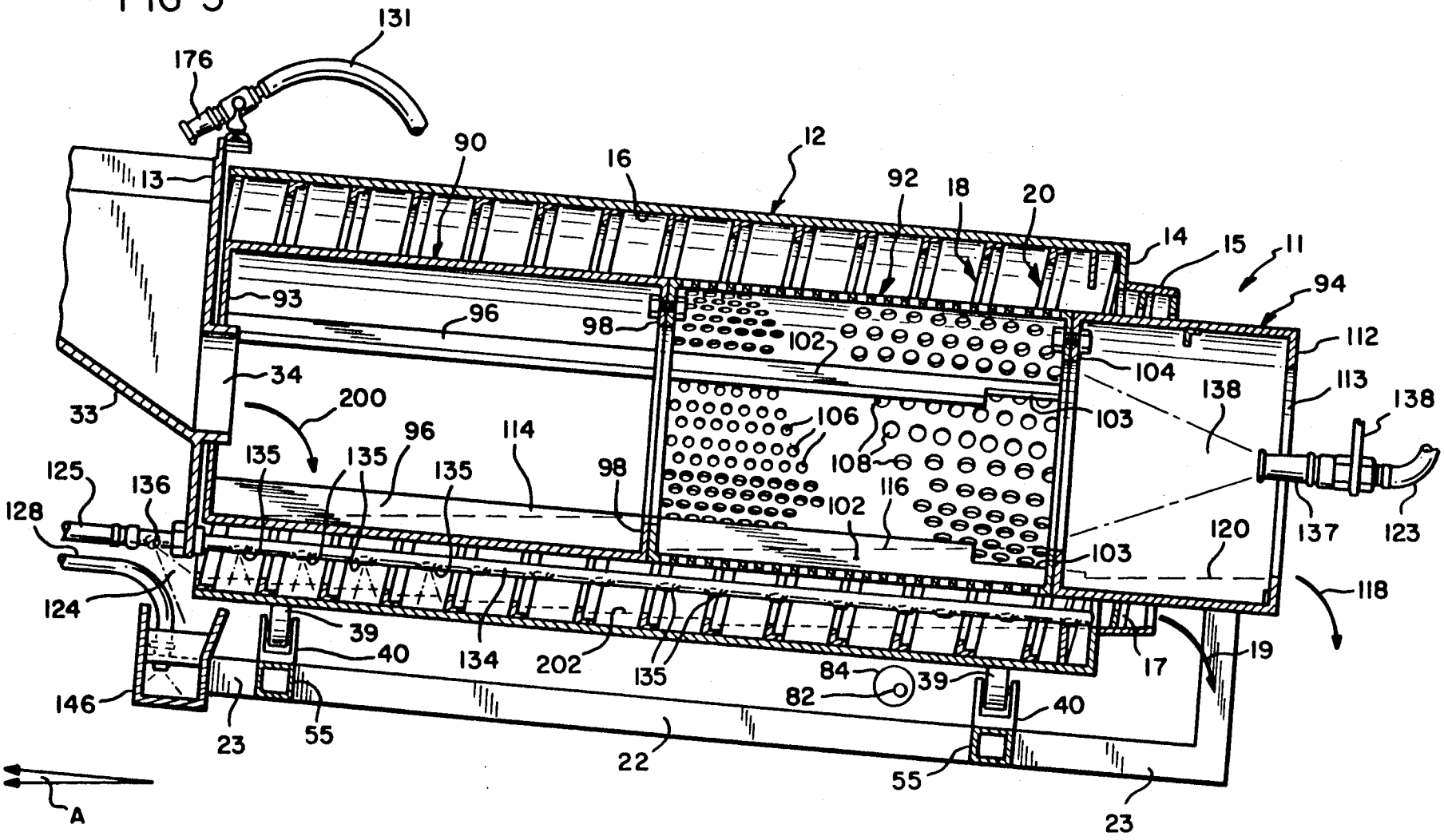
FIG. 5 is a longitudinal elevational sectional view taken along the lines 5—5 of FIG. 2.

As illustrated in FIG. 5 the lower end of the outer drum 12 is formed with the annular, radially inwardly extending lip 14. The lip 14 extends inwardly toward the axis of the outer drum 12 a short distance, which in the embodiment depicted and described may be approximately ten inches. The lower end of the outer drum 12 is also comprised of a longitudinally extending frusto-conical annular drum extension 15 that extends axially away from the cylindrical portion of the outer drum 12 and converges toward the inner barrel 11. On the interior concave frusto-conical wall of the extension 15 there is at least one radially inwardly extending spiral vane 17. The spiral vane 17 is oriented in the same direction as the vanes 18 and 20 on the interior cylindrical wall surface 16 of the outer drum 12.

The drum extension 15 and the spiral vane 17 defined thereon serve as a surge inhibitor to prevent fine heavy particles from being discharged from the outer drum 12 as tailings. Lighter materials, such as sand and dirt are discharged from the drum extension 15 as tailings indicated diagrammatically at 19 in FIG. 5. The wall of the extension 15 is tapered inwardly from perpendicular alignment relative to the lip 14 at an angle of about four to twelve degrees.

The Chassis 17

The mobile chassis 17 is comprised of a stabilized supporting framework 20 and a floating support 21 upon which the outer drum 12 is mounted. Both the stabilized supporting framework 20 and the floating support 21 are formed of lengths of hollow, square steel tubing that are joined orthogonally. The stabilized framework 20 is comprised of longitudinally oriented steel tubing lengths 22, 23, 24, 25 and 26, transverse tubing lengths 27 and 28 and upright tubing lengths 29, 30 and 31, all welded together. The stabilized supporting framework tubing members generally circumscribe an open skeletal frame.

The forward upright tubing lengths 30 are secured to a flat, rectangular transverse steel end plate 32 to which an ore hopper 33 is secured. The hopper 33 may extend forwardly from the end plate 32 a distance of about ten feet at its upper edge. A large opening is defined in the steel end plate 32. At the lower extremity of the hopper 33 there is a cylindrical annular hopper chute 34 that extends through the opening in the end plate 32.

The stabilized framework 20 is mounted upon a pair of supporting wheels 44 having rubber tires thereon which support the stabilized framework 20 from beneath through leaf springs 45. At the front of the chassis 17 there is yoke 46 having a tongue 47 equipped with a tow hitch coupling 48. The tow hitch coupling 48 is provided to allow the placer recovery apparatus 10 to be pulled behind a truck.

Retractable rear stabilizing legs 49 are located at the rear end of the placer recovery apparatus 10 behind each of the wheels 44. The retractable rear stabilizing legs 49 are mounted on the stabilized framework 20 and include telescoping elements which can be lowered as depicted in FIG. 1 to aid in stabilizing the framework 20 during operation of the placer recovery apparatus 10. At the front of the placer recovery apparatus 10 an adjustable front leg 50 is secured to the yoke 46. The front leg 50 serves to stabilize the front of the placer recovery apparatus 10 and includes a telescoping foot 51 that is operated by means of a crank 52 to raise or lower the yoke 46 relative to the wheels 44. The adjustable front supporting leg 50 is thereby used to adjust the angle of inclination of the stabilized framework 20, and thus the angle of inclination of both the inner barrel 11 and the outer drum 12. This angle is indicated at A in FIG. 5.

The floating support 21 is a generally U-shaped structure, the tubular steel legs 55 of which extend transversely relative to the chassis 17. The legs 55 are welded to a longitudinal tubular steel member 35, visible in FIGS. 2 and 6. The opposite ends of the transverse legs 55 are linearly aligned with the transverse members 27 of the stabilized framework 20 and are joined thereto by hinge connections. The hinge connections allow the floating support 21 to oscillate in an arc relative to the stabilized framework 20 about a longitudinal axis of rotation indicated at 36 in FIG. 2.

Figure 6:
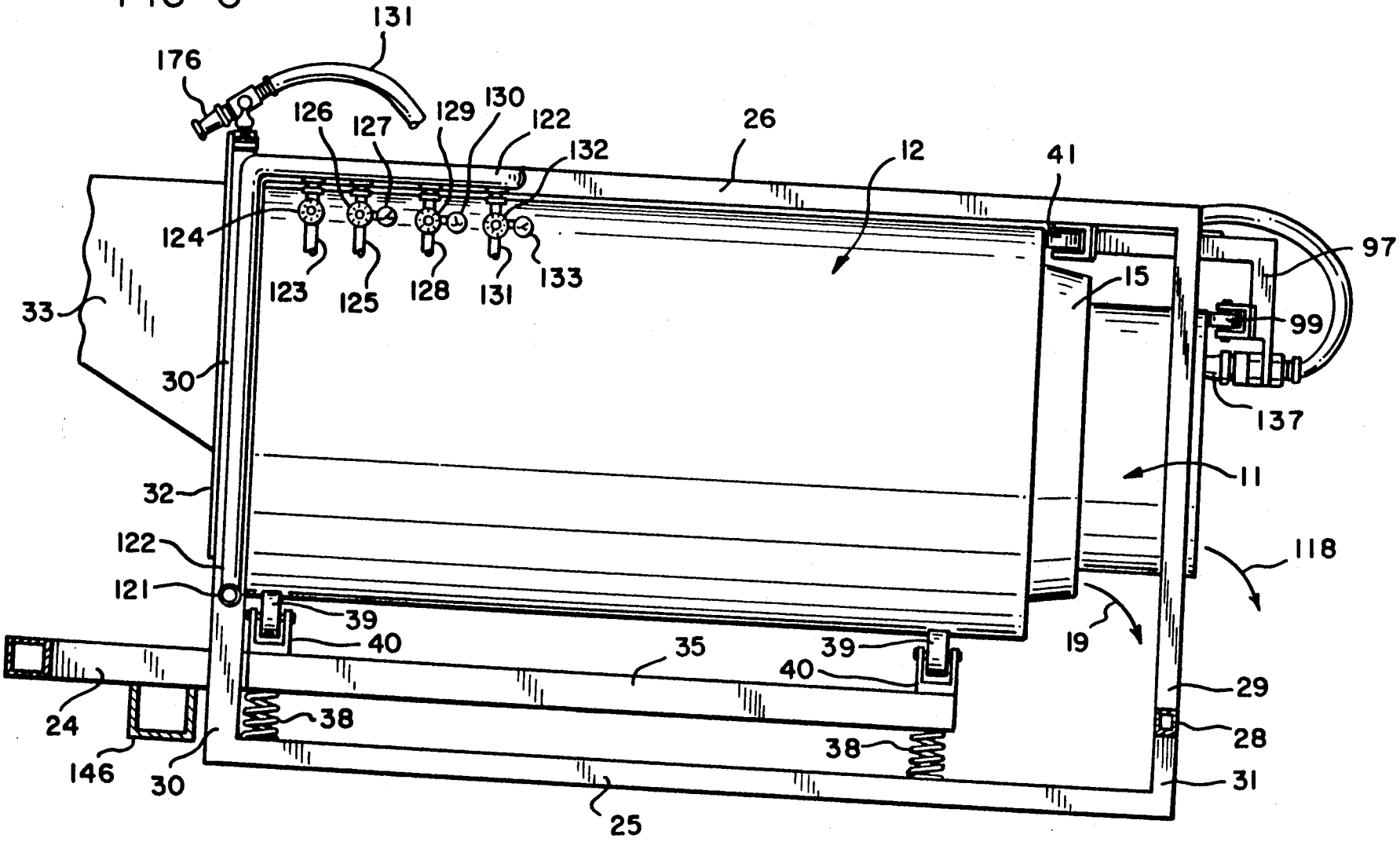
FIG. 6 is a longitudinal elevational sectional view taken along the lines 6—6 of FIG. 4.

The longitudinal tubular member 35 of the floating support 21 is aligned directly above the longitudinal member 25 of the stabilized framework 20. A pair of coil springs 38 are interposed between the two parallel, vertically aligned, tubular members 25 and 35, as illustrated in FIG. 6. The longitudinal member 35 of the floating support 21 is thereby supported above the longitudinal member 25 of the stabilized framework 20 and can oscillate relative thereto.

Figure 4:
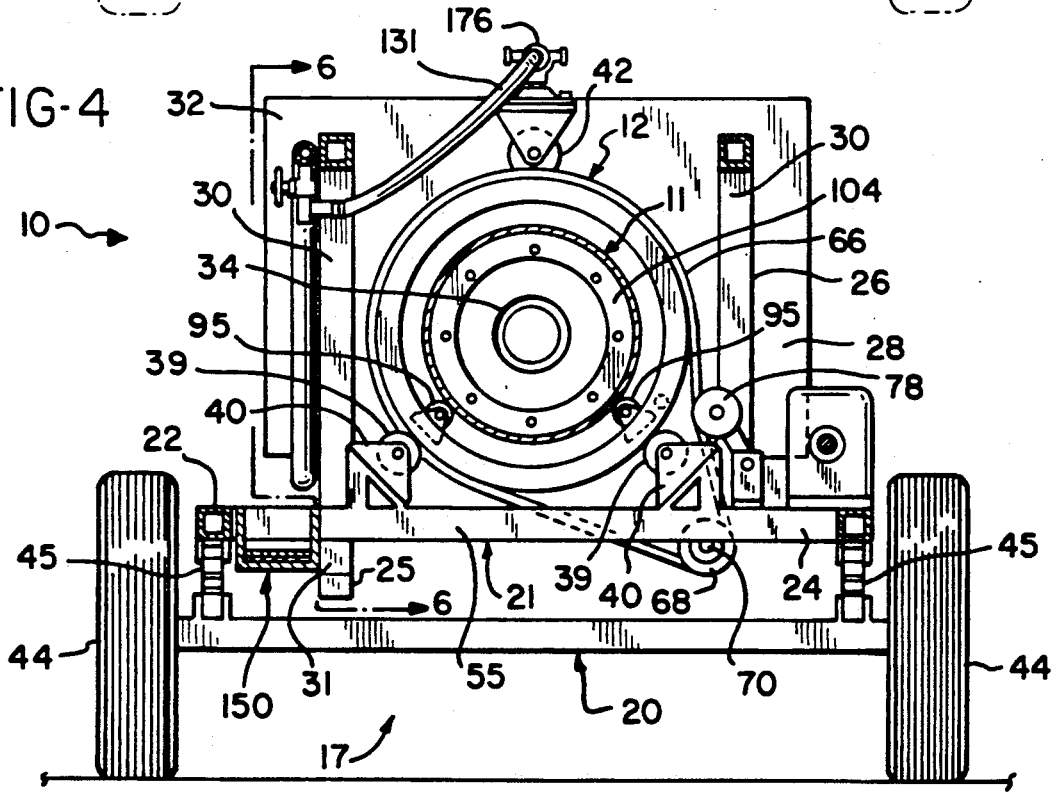
FIG. 4 is a transverse elevational sectional view taken along the lines 4—4 of FIG. 2.

The outer cylindrical drum 12 is mounted upon the floating support 21. Front and rear pairs of supporting rollers 39 are interposed between the floating support 21 and the outer cylindrical surface of the outer drum 12 in spaced separation from each other along the transverse legs 55 of the floating support 21, as illustrated in FIG. 4. The rollers 39 are rotatably mounted in roller brackets 40 and support the outer drum 12 from beneath. Stabilizing rollers 41 and 42 respectively bear longitudinally against the lip 14 at the lower end of the outer drum 12 and radially inwardly against the top of the outer surface of the outer drum 12 as illustrated in FIGS. 1 and 4. The rollers 41 and 42 are mounted in roller brackets that are secured to the stabilized framework 20.

The outer drum 12 is driven in rotation by means of a drive belt 66, which in turn is driven by a pulley 68. The pulley 68 is driven by a power take off shaft 70, that in turn is driven by a chain 72. A gasoline or diesel engine 74 turns its engine drive shaft and a drive sprocket 76 to advance the chain 72 to rotate the power take off shaft 70. The engine 74 is mounted on the stabilized framework 20 and the power take off shaft is journaled for rotation relative to the stabilized frame 20 as well. The power take off shaft 70 is journaled for rotation in pillow blocks 144 that are attached to the stabilized supporting framework 20, as depicted in FIG. 3.

A speed reduction sprocket 77 is keyed to the power take off shaft 70 so that the drive belt 66 rotates the outer drum 12 at a much lower speed than the speed of rotation of the drive shaft of the engine 74. Typically the outer drum 12 is driven in rotation at a speed of between one and ten revolutions per minute, preferably between about four and eight revolutions per minute. A spring biased tensioning roller 78 is mounted on the stabilized framework 20 by means of a spring biased arm. The tensioning roller 78 bears against the belt 66 to maintain tension in the belt 66.

Figure 3:
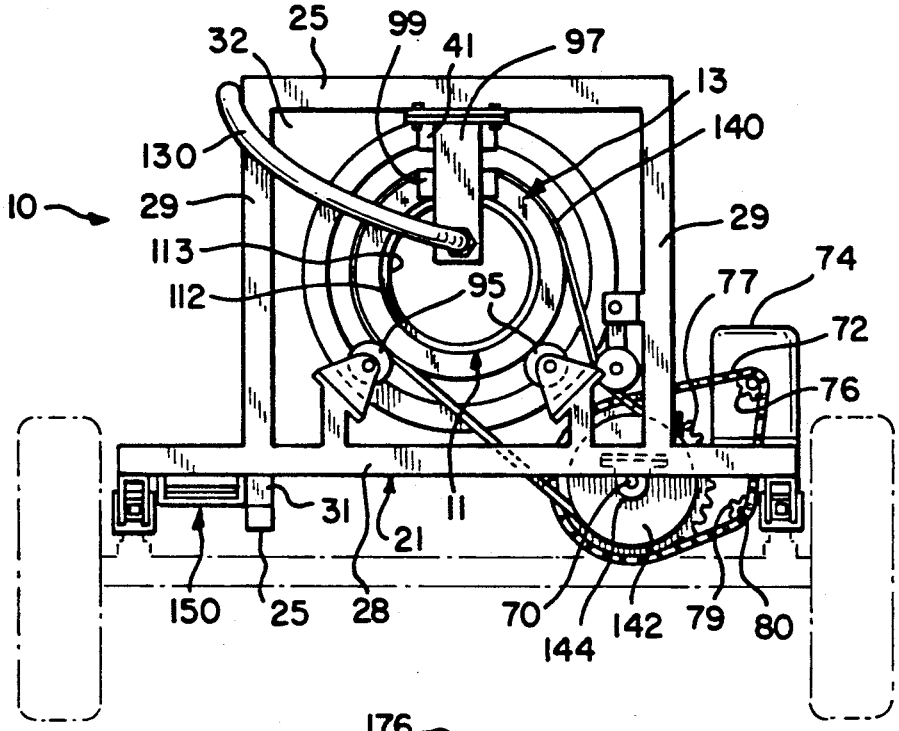
FIG. 3 is an end elevational view taken along the lines 3—3 of FIG. 1.

The chain 72 also drives another sprocket 79, visible in FIG. 3. The sprocket 79 is keyed to a transmission input shaft 80 that is journaled for rotation relative to the stabilized frame 20. The transmission input shaft 80 extends longitudinally forward to a speed reducing gear box 81.

The speed reducing gear box 81 is mounted on the stabilized frame 20 and changes both the speed and direction of rotation of the transmission input shaft 80. From the speed reducing gear box 81 a transmission output shaft 82 extends transversely at right angles to the transmission input shaft 81, passing beneath the outer drum 12. The end of the transmission output shaft 82 remote from the speed reducing gear box 81 is journaled in a supporting bearing 83 that is located on the facing surface of the longitudinal tubing member 35 of the floating support 21.

The transmission input shaft 80 rotates at approximately one thousand revolutions per minute, while the transmission output shaft 82 from the gear box 81 rotates at a speed of approximately three hundred revolutions per minute. The transmission output shaft 82 is employed to impart vibrations to the outer drum 12. A weighted disk 84 is mounted eccentrically on the transmission output shaft 82 between the bearing 83 and the gear box 81. The eccentric disk 84 rotates freely beneath the outer drum 12 and may be formed of a disk-shaped ten pound weight mounted eccentrically so as to exert a two pound throw. The eccentric disk 84 resides beneath the outer drum 12 in a vertical plane aligned parallel to the axis of the outer drum 12 and is visible in FIG. 5.

The rotating eccentrically mounted weight 84 functions as a means for applying vibration to the outer drum 12 relative to the stabilized framework 20. The eccentric throw of the rotating disk 84 causes the legs 55 of the floating support 21 to move in oscillation relative to the members 27 of the stabilized framework 20 about the axis 36. The hinge connections between the legs 55 of the floating support 21 and the members 27 of the stabilized framework 20 permit this motion. The springs 38 which are interposed between the longitudinal member 35 of the floating support 21 and the longitudinal member 25 of the stabilized framework 20 enhance the oscillatory affect.

The oscillation of the floating frame 21 relative to the stabilized framework 20 allows these components to act as a vibrating means interposed between the stabilized supporting framework 20 and the outer drum 12 to impart vibrations to the outer drum 12. The spring biased tensioning roller 78 ensures that tension is maintained in the belt 66 despite the vibration of the outer drum 12 relative to the stabilized supporting framework 20.

The Inner Barrel 11

The cylindrical inner barrel 11 may be formed of lengths of steel tubing about three and one half feet in diameter and about forty two feet in length. The inner barrel 11 is comprised of three sections, namely an upper fragmentation section 90, an intermediate trommel section 92, and a lower discharge section 94. The interior of the cylindrical inner barrel 11 is illustrated in FIG. 5.

At its upper end the fragmentation section 90 is formed with an annular upper end wall 93 which defines a central axial opening therein. The edges of the end wall 93 are radially supported by the cylindrical chute 34 at the upper or upstream end of the inner barrel 11 by means of bearings, thereby holding the upper end of the cylindrical, annular inner barrel 11, in coaxial alignment with both the chute 34 and with the cylindrical, annular outer drum 12. The lower end of the cylindrical, annular inner barrel 11 is supported by rollers 95 from beneath, as illustrated in FIG. 4. The rollers 95 are mounted for rotation within brackets that are secured to the rear transverse tubing member 28 of the stabilized framework 20. The rollers 95 ride against the convex outer surface of the discharge section 94 to thereby maintain the lower end of the cylindrical, annular inner barrel 11 in coaxial alignment within the outer drum 12. Mounting bracket 97, secured to the rearmost upper cross member 25 of the stabilized framework 20 carries another roller 99. The roller 99 bears against the lip 112 of the downstream end of the inner barrel 11 to provide stabilization at the rear of the barrel 11.

Figure 2:
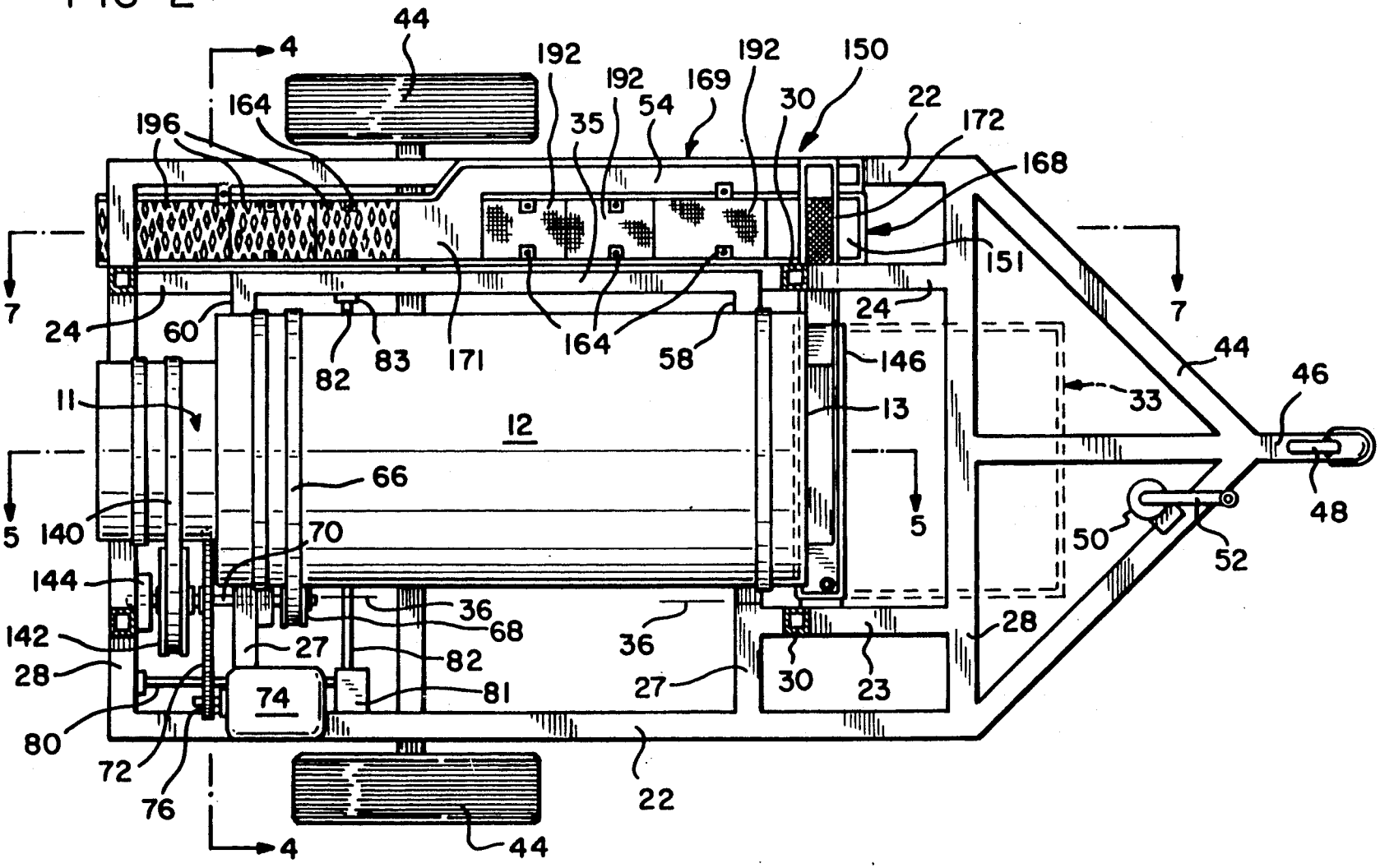
FIG. 2 is a plan sectional view taken along the lines 2—2 of FIG. 1.

As illustrated in FIGS. 2 and 3, the inner barrel 11 is driven in rotation by means of a belt 140 which is driven from a pulley 142 that is attached to the power take off shaft 70. The pulley 142 is driven by the motor 74 through the drive chain 72. The pulley 142 is larger than the pulley 68 and the outer diameter of the inner barrel 11 is smaller than the outer diameter of the outer drum 12. Consequently, the engine 74 drives the inner barrel 11 through the belt 140 at a speed greater than the speed of rotation of the outer drum 12. The engine 74 drives the inner barrel 11 at a speed of between about twenty and thirty revolutions per minute while driving the outer drum 12 at a speed of between about one and ten revolutions per minute.

The upper fragmentation section 90 of the inner barrel 11 has three longitudinally oriented impact vanes 96 angularly spaced from each other at uniform one hundred twenty degree intervals apart about the interior diameter of the fragmentation section 90, as illustrated in FIG. 5. The vanes 96 are radially aligned within the fragmentation section 90 and extend inwardly into the interior thereof a distance of about five inches. A radially inwardly extending annular lip 98 is formed at the lower or downstream end of the fragmentation section 90 to delineate the fragmentation section 90 from the trommel section 92. The lip 98 is formed by the facing juxtaposed annular flanges on the downstream and of the fragmentation section 90 and on the upstream end of the trommel section 92. The flanges are bolted to each other at spaced intervals. The annular lip 98 extends radially inwardly toward the axis of rotation of the inner barrel 11 a distance of approximately three inches.

The intermediate trommel section 92 is likewise comprised of three longitudinally aligned vanes 102 which are angularly spaced from each other a uniform distance of one hundred twenty degrees apart. The upstream portions of the vanes 102 extend radially inwardly a distance of five inches. At their downstream extremities the vanes 102 are cut away as indicated at 103 so as to allow material to remain in the trommel section 92 longer. At the lower downstream extremity of the trommel section 92 there is a lower inwardly extending annular lip 104. The lip 104 is formed by the facing juxtaposed annular flanges on the downstream end of the trommel section 92 and on the upstream end of the discharge section 94. These flanges are bolted together at spaced intervals throughout their interfaces. The lip 104 delineates the intermediate trommel section 92 from the lower discharge section 94 and extends radially inwardly a distance of about three inches.

The cylindrical wall of the trommel section 92 is perforated with a multiplicity of openings throughout. At its upper or upstream end the cylindrical wall of the trommel section 92 is punched with a multiplicity of fine perforations 106, each about one-quarter inch in diameter. The finely perforated portion of the trommel section 92 extends longitudinally from the upstream end thereof toward the lower or downstream end about forty percent of the total length of the trommel section 92. At that point a multiplicity of coarse perforations 108 commence. The coarse perforations 108 are typically about one and three-quarters inches in diameter. The coarsely perforated portion extends all the way to the lower annular lip 104 at the lower end of the trommel section 92.

The lower discharge section 94 of the cylindrical, annular inner barrel 11 includes, in addition to its upstream flange, a radially inwardly directed lower annular lip 112 at its lower extremity. The lip 112 also extends radially inwardly a distance of approximately three inches and defines therewithin a downstream opening 113.

As illustrated in FIG. 5, the fragmentation section 90, the trommel section 92, and the discharge section 94 of the cylindrical, annular inner barrel 11 are all of a uniform outer diameter and are all securely bolted together in mutual longitudinal alignment so as to rotate as a unit within the cylindrical, annular outer drum 12. As the inner barrel 11 rotates, large clumps of aggregate matter are lifted by the vanes 96 and dropped, so as to break up the material passing through the inner barrel 11 as much as possible. The height of the lip 98, and the angle of inclination A serve to define a level of repose 114 of fragmentation placer ore lying within the fragmentation section 90. As the volume of material in the fragmentation section 90 increases above the level of repose 114, the material will pass from the fragmentation section 90 into the trommel section 92.

In the trommel section 92 the fragmentation material is sifted, with particles of one-quarter inch mesh and finer passing radially outwardly into the surrounding outer drum 12, commencing immediately in the upstream portion of the trommel section 92. Larger particles are lifted and fragmented further by the vanes 102. The apertures 108 in the downstream portion of the trommel section 92 allow larger pieces of material up to a maximum dimension of one and three-quarter inches to pass through the wall of the trommel section 92 radially outwardly and into the surrounding annular outer drum 12. Together the lip 104, and the angle of inclination A define a level 116 of ore within the trommel section 92. As the volume of material within the trommel section 92 builds up above the level 116, large chunks of material pass downstream out of the trommel section 92 and into the discharge section 94.

The lip 112 of the discharge section 94 forms a barrier over which large pieces of lighter material are discharged as a tailing, indicated generally at 118. The lip 112 forms a barrier which tends to retain the heavier material within a level of ore indicated at 120. The material immediately upstream from the lip 112 in the discharge section 94 can be easily viewed through the opening 113 delineated by the lip 112. Thus, it is quite possible to see large nuggets of gold or other heavy material which may collect within the material rising to the level of ore 120 by merely looking through the opening 113. These nuggets can be removed to add to the total amount of gold recovered.

The Water Supply

In order to process placer ore through the placer recovery apparatus 10, a source of water is necessary for washing, spraying and sluicing. A conventional water pump (not shown) is carried on the mobile supporting chassis 17, but is deployed in a stream bed or a river bed in a conventional manner in order to pump the necessary water to the system. The pump is equipped with a hose which is releasably coupled to a hose coupling 121 that provides an inlet to a water supply manifold 122 which is mounted on one of the forward upright tubing members 30 of the stabilized supporting framework 20, as illustrated in FIG. 6. The water supply manifold 122 passes upwardly and makes a right-hand turn rearwardly along one of the upper, longitudinally extending tubing lengths 26 on the side of the chassis 17.

The water supply manifold 122 has one outlet leading to a wash water hose line 123 through a manual control valve 124. Another tap from the water supply manifold 122 leads to a spray bar supply hose 125 having a manually adjustable valve 126 therein. A flow meter gauge 127 is located at the valve 126. Another tap from the water supply manifold 122 leads to a sluice water supply hose 128 having a manually adjustable valve 129 therein. A flow meter gauge 130 registers the flow of water to the hose 128. The water supply hose 131 having a manually operable valve 132 therein. A flow meter gauge 133 registers the volume of water flow to the hopper supply hose 131.

The Spray Bar 134

The spray bar hose 125 leads to the lower edge of the end plate 32 and is connected to an elongated spray bar 134 which directs water to the open upper end of the outer drum 12, as indicated in FIG. 5. The spray bar 134 is secured to and passes through the transverse upright hopper end mounting plate 32 from the front and emerges therefrom on the downstream side thereof as depicted in FIG. 5. The spray bar 134 is approximately two inches in outer diameter and extends the entire length of the inner cylindrical surface 16 of the outer drum 12. The spray bar 134 extends into the annular space between the outer cylindrical drum 12 and the inner cylindrical barrel 11. The spray bar 134 includes a plurality of nozzles 135 which are directed radially outwardly toward the inner wall of the outer drum 12. Another nozzle 136 forward of the end plate 32 sprays the lower edge of the upper end 13 of the outer drum 12 where material is discharged therefrom.

Wash Water to the Inner Barrel 11

The wash water supply hose 123 extends to the lower or downstream end of the placer recovery apparatus 10 and is connected to a water nozzle 137 that is held from the rearmost upper transverse stabilized framework member 25 by means of the mounting bracket 97. The water nozzle 137 extends through the central opening 113 at the downstream end of the discharge section 94 of the inner barrel 11. The water nozzle 137 is longitudinally aligned with the common axis of rotation of both the inner barrel 11 and the outer drum 12. The nozzle 137 directs a fine spray of water, indicated in FIG. 5 at 138, through the opening at the junction of the trommel section 92 and discharge section 94 and up into the downstream portion of the trommel section 92.

The Hopper Water Supply

The upper water supply line 131 is connected to a nozzle 176 which is attached by a gimbal mount to the transverse hopper mounting plate 32. The nozzle 176 can be directed as desired to either an ore chute 178, or the ore hopper 33, as depicted in FIGS. 1 and 6.

The Sluice Box 150

Figure 8:
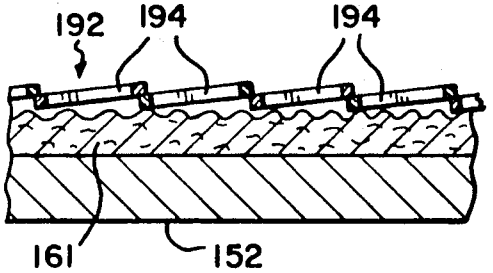
FIG. 8 is an enlarged elevational detail indicated at 8 in FIG. 7
Figure 7:
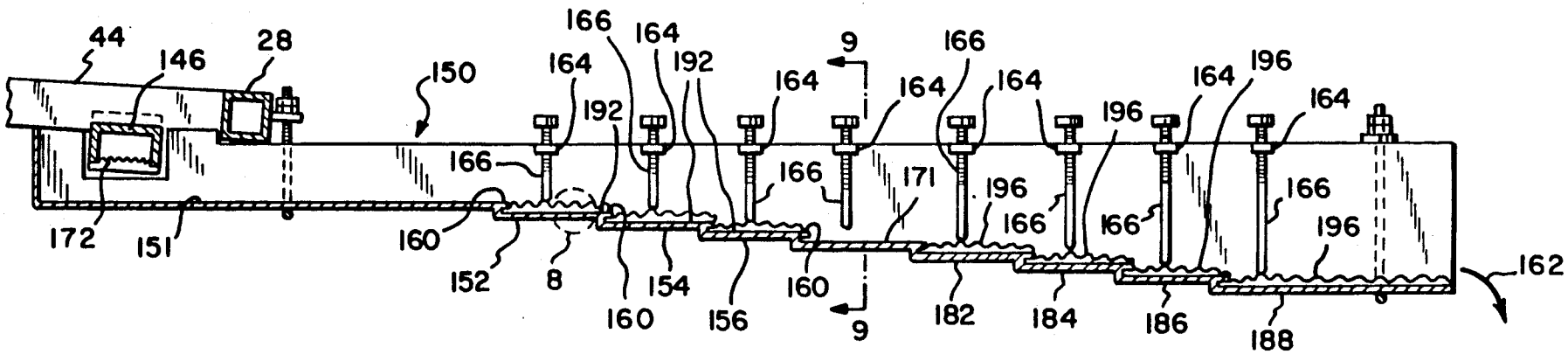
FIG. 7 is a sectional elevational view of the sluice box of the placer recovery system taken along the lines 7—7 of FIG. 2.

Beneath the upper end 13 of the outer drum 12 there is a transverse trough 146 disposed to receive fine particles of heavy material that are not discharged as either large, light tailings or as small light tailings 19, but to the contrary are carried back by the screw action of the helical vanes 17, 18 and 20 and ejected from the upper, upstream end 13 of the outer cylindrical drum 12. The fine particles of heavy material are ejected from the upper end 13 of the outer cylindrical drum 12 in a slurry with water in the outer drum 12 that is forced upwardly by means of the inclined vanes 17, 18 and 20. The sluice water supply hose 131 is secured in position, as depicted in FIG. 5 to provide additional water from the water supply manifold 122 to the sluice box 150 through the trough 146. The trough 146 extends transversely and is inclined at a slight downward slope toward the sluice box 150, which is illustrated in FIGS. 2, 7 and 8.

The sluice box 150 is longitudinally aligned and is located alongside the outer cylindrical drum 12 and in generally parallel alignment therewith. As best illustrated in FIGS. 2 and 5, the sluice box 150 is located to receive as an input the discharge of water and entrained solids from the upper end 13 of the outer cylindrical drum 12 by way of the transverse trough 146. Of all of the solid material processed through the placer recovery apparatus 10 only about five percent by volume is discharged into the trough 146.

Figure 9:
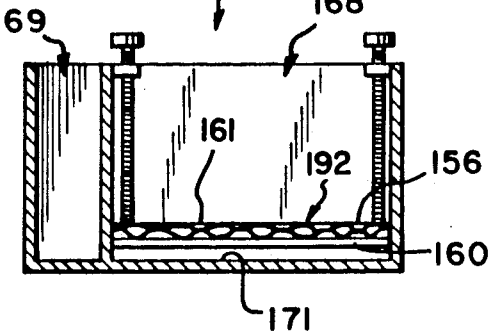
FIG. 9 is a transverse sectional view taken along the lines 9—9 of FIG. 7.

In processing larger quantities of placer ore it is highly desirable to separate the coarsest materials to be processed in the sluice from the finest materials. This can be achieved with the sluice box 150 which has a main channel 168 that is about two feet in width and a coarse solid bypass channel 169. The bypass channel 169 is about ten inches in width and extends parallel to the main channel 168 for about one half the overall length of the sluice box 150. The overall length of the sluice box 150 is preferably about thirty two feet in the embodiment described. The bypass channel 169 rejoins the course of the main channel 168 at a lower stilling plate 171, as illustrated in FIGS. 7 and 9.

The slurry of fine heavy material that is discharged into the trough 146 from the upper end of the outer cylindrical drum 12 is carried laterally down the inclined trough 146 and passes over a fine mesh screen 172 that is disposed in a downwardly facing opening in the trough 146. This opening is located directly above the uppermost end of a main channel 168. The trough 146 then continues past the screen 172 and the main channel 168 directly therebeneath to the upper end of the bypass channel 169.

The fine mesh screen 172 has a mesh size which is preferably about 250. The screen 172 allows the finest heavy particles to pass therethrough and thus fall directly into the upper end of the main channel 168. Coarser particles, however, will not pass through the screen 172. Instead, they are carried past the main channel 168 and fall into the upper end of a bypass channel 169 through an unscreened opening in the bottom of the trough 146.

The main channel 168 of the sluice box 150 is illustrated in FIG. 7 and is comprised of a first plurality of vertically offset landings 152, 154 and 156 in a first flight of landings, a lower stilling plate 171, and a second plurality of vertically offset landings 182, 184, 186 and 188 in a second flight of landings. Each plurality or series of vertically offset steps or landings 152–158 and 182–188 in each flight is arranged in a cascade. Each step is comprised of a landing and a lip overhanging the landing. The slurry of material that passes through the fine mesh screen 172 flows through the main channel 168 of the sluice box 150 and cascades downwardly from each landing to the landing below. Each of the landings above the lowermost landing 188 terminates in a lip 160 that overhangs the landing below. The lighter material in the slurry is discharged from the lower extremity of the sluice box 150 as fine tailings where indicated at 162, while the heavy materials are trapped on the landings 152–158 and 182–188.

To aid in holding particles of heavy metal, such as gold, the sluice box landings are provided with sections of matting 161 and sections of screens located thereatop. The landings 152–156 in the first flight are provided with sections 192 of expanded metal screens having a cross section depicted in detail in FIG. 8. The expanded metal screen sections 192 are formed from lengths of wire welded together into a mesh. Each length of wire undulates at an angle of forty five degrees relative to the horizontal. The structure of the screen sections 192 is defined with a multiplicity of openings 194. The openings 194 in the screen section 192 have dimensions of three-quarters of an inch by one-half of an inch and are diamond-shaped when viewed from above.

The landings 182–188 in the second flight of landings are likewise provided with expanded metal screen sections 196 which have larger diamond-shaped openings measuring one and three-quarters of an inch by three-quarters of an inch. The configurations of the openings 194 in the screen sections 196 are illustrated in plan view in FIG. 2. The cross section of the screen sections 196 is identical to that depicted in FIG. 8. The only difference between the screen sections 192 and 196 is the size of the openings 194 therein.

Beneath the screen sections 192 and 196 there are sections of ribbed felt mats 161. The mat sections 161 are merely formed of strips of felt carpeting. The ribs on the mats 161 are oriented to extend transverse to the direction of slurry flow and project upwardly beneath the screen sections 192 and 196.

Along the upper edges of the sides of the sluice box 150 there are a number of mounting tabs 164 that project laterally inwardly over the various landings. These mounting tabs 164 are tapped to receive mounting screws 166. The mounting screws 166 have thumb screws which can be adjusted to bear downwardly and hold the screens sections 192 and 196 and the mat sections 161 in place on the landings 152–158 and 182–188. As the slurry of fine material in water flows across the landings 152–158, vortexes are created beneath the ridges formed by the screen sections 192. These vortexes aid in trapping the extremely fine particles of heavy material metals, such as gold. Also, the screen openings 194 aid in allowing the very tiny particles to be trapped atop the mat sections 161 and beneath the screen sections 192, while larger sand particles are carried along and discharged with the light tailings 162.

The first flight of landings 152–158 are located within the upper half of the main channel 168 of the sluice 150. Thus, the fine particles of gold which pass through the screen mesh 172 are directed along a path that is initially separate from the path of the coarse particles that cannot pass through the screen 172. Virtually all of the fine particles of gold of a mesh size of between 250 and 500 are collected on the landings 152–158.

The coarser particles of material received from the upper end 13 of the outer drum 12 flow through the parallel bypass channel 169 and then are directed back into the lower section of the main channel 168 where the channels 168 and 169 join at the lower stilling plate 171. Since virtually all of the fine particles of gold are collected in the upper flights 152–158 the coarser particles are not mixed with the fine particles, but instead pass over only the second flight of steps or landings 182–188 for collection thereon.

The reasons for separating the coarse heavy particles from the fine heavy particles with the screen 172 is because a flow of coarse and fine particles together is likely to result in the loss of the fine particles. This is because the coarse particles, as they flow downstream, tend to create a vortex in their wake. This turbulent vortex tends to prevent the very fine particles of gold from settling out on the flights of the sluice. To the contrary, the lighter particles would be sucked along in the turbulent wake of the coarser particles and would thus be lost. By separating the coarse particles from the fine particles for processing in the sluice 150, the fine particles are not subjected to the turbulent effects created by the downstream travel of the coarser particles and instead are trapped in the upper flights 152–158 of the main channel 168 of the sluice 150. The separation of the coarser particles from the finest particles by means of the screen 172 significantly increases the efficiency of collection of the fine particles of gold.

Implementation of the Method

In the practice of the method of the invention the placer recovery apparatus 10 is towed behind a truck or other heavy vehicle by means of the tongue 46 and the tow hitch 48 to a placer ore site. The apparatus 10 rolls easily on the rubber tired wheels 44, even over very poor roads.

Once the apparatus 10 has arrived at the job site, the rear legs 49 are lowered and locked in position so that the supporting framework 20 is stabilized and so that the transversely extending members thereof are substantially horizontally aligned. The front leg 50 is then deployed by means of the crank 52 so as to tilt the apparatus rearwardly to an angle of inclination A, which typically is between about two degrees and fifteen degrees relative to horizontal. Adjustment of the front leg 50 to tilt the axis of rotation of the outer drum 12 and the inner barrel 11 at an angle of about eight degrees is typical for many consistencies of placer ore.

The water pump hose is coupled to the coupling 121 and the water pump intake is immersed in a large water supply, such as a river or lake. The apparatus 10 is located as close as possible to water level, so as to minimize the load on the water pump. The gasoline engine 74 is thereupon started. The engine 74 drives the engine drive shaft and the power take off shaft 70 in rotation to turn the drive pulley 76. The engine may also be used to operate the water pump, or the water pump may be independently powered. In either case water is pumped through the coupling 121 into the water intake manifold 122 and from there through the valves 124, 126, 129 and 132 to the wash water hose 123, the spray bar supply hose 125, the sluice water supply hose 128, and the hopper water supply hose 131. The valves 124, 126, 129 and 132 are adjusted as appropriate.

With the engine 74 in operation, the outer cylindrical drum 12 is driven in counter-clockwise rotation, as viewed in FIGS. 3 and 4 at a first angular velocity of perhaps five revolutions per minute by means of the drive belt 66. Concurrently, the drive belt 140 turns the inner hollow barrel 11, also in a counter-clockwise direction, at a second, higher speed of perhaps about twenty six revolutions per minute. The water supply manifold 122 draws an intake of no greater than five hundred gallons of water per minute and dispenses the water through the nozzles 137 and 176, the sluice water supply line 128 and the spray bar 134.

Placer ore is then loaded into the hopper 33 from the chute 178 at a volume of approximately one hundred twenty cubic yards per hour. The coarse placer ore enters the cylindrical inner barrel 11 through the chute 34 in a flow indicated at 200 in FIG. 5. As the placer ore enters the fragmentation section 90 of the inner barrel 11, the longitudinal vanes 92 carry the ore upwardly toward the top of the inner barrel 11, and drop the ore to the bottom thereof, thereby breaking up agglomerations and aggregations into smaller pieces.

The ore reaches a first level 114 within the fragmentation section 90, and then flows over the lip 98 into the trommel section 92 of the inner barrel 11. The ore is likewise carried upwardly in rotation by the vanes 102 in the trommel section 92 and dropped to the bottom thereof, thereby aiding in further fragmentation. Also, particles of the size of one-quarter of an inch and smaller pass through the perforations 106 in the trommel section 92 and pass radially outwardly from the inner barrel 11 into the outer drum 12. Similarly, even larger particles of up to one and three quarter inches in dimension pass through the apertures 108 and likewise are discharged into the outer drum 12. The very large chunks of material that remain in the inner barrel 11 pass into the discharge section 94 and are ultimately discharged. These larger, lighter stones are discharged as light, coarse tailings as indicated at 118.

Due to the presence of the annular end lip 112, large, heavy material will tend to remain trapped within the discharge section 94, as that heavy material will normally reside beneath the level 120. The discharge section 94 is periodically checked for the presence of gold nuggets, which can be removed and added to the finer gold dust recovered from the sluice box 150.

The material that passes from the trommel section 92 into the outer cylindrical drum 12 is acted upon by the spiral vanes 18 and 20 that serve as reverse spirals or screws. That is, as the inner barrel 11 and outer drum 12 rotate in the same direction but at their respective speeds, and as tailing material passes through the inner barrel 11 from left to right, as viewed in FIG. 5, the finer material entrained in a slurry and entrapped within the outer drum 12 is acted upon by the reverse spiral action of the vanes 18 and 20. The heavier particles of this material tend to sink rapidly toward the interior concave surface 16 of the interior cylindrical wall, both due to the force of gravity and due to centrifugal action created by rotation of the outer cylindrical drum 12. This heavier material will thereby tend to lie beneath the slurry level, indicated at 202 in FIG. 5, which is within one and one-half inches of the surface of the interior cylindrical wall 16. This heavier material is thereby forced back forwardly and upwardly from the lower end of the outer drum 12 toward the upper end thereof by virtue of the screw action of the reverse spiral vanes 18 and 20.

An additional material is loaded into the hopper 33, there is a tendency for surging which tends to act in opposition to the force of the reverse spiral vanes 18 and 20 and to carry material out of the lower end of the outer drum 12. However, the frusto-conical annular extension 15 from the radially inwardly directed lip 14, and the reverse spiral vane 17 thereon, serve to counter this surging effect. This keeps the heavier particles within the outer drum 12 and prevents them from being carried out as fine tailings 19. The lighter material, on the other hand, is discharged as fine tailings 19

The mechanism for vibrating the outer drum 12 aids in separating fine, heavy material in the outer drum 12 in the concentration process The oscillating moment created by the rotation of the eccentric disk 84 causes the floating framework 21 to oscillate and vibrate relative to the stabilized framework 20. This vibration is transmitted to the outer drum 12 through the brackets 40 and rollers 39. This vibration action tends to dislodge the solid material from the interior wall surface 16 of the outer drum so that this solid material drops back into the liquid slurry 202, where it is subjected to the screw action of the vanes 18 and 20.

Since the oscillatory force is applied beneath the left-hand side of the outer drum 12, as viewed in FIG. 4, the dislodging affect of vibration is greatest on the right-hand side of the outer drum 12. The right-hand side is where the material will tend to cling to the wall surface 16 as the wall surface rotates counter-clockwise through the slurry 202.

The fall of material back into the slurry 202 from the cylindrical wall surface 16 aids in separating agglomerated particles as well, so that the separated lighter material is carried away in the downstream water flow over the spiral vanes 18 and 20, and over the spiral vane 17 in the extension 15. The light solid material is thereby largely discarded in the tailings 19. This leaves only the very heaviest solid material to be pushed up the spiral incline by the spiral vanes 18 and 20. Thus, only the very heaviest of this material is discharged into the trough 146. With an ore input into the hopper 33 at the rate of one hundred twenty yards per hour, only about two cubic yards per hour of solid material are discharged into the trough 146 for processing by the sluice box 150.

With ore being processed from the hopper 33 at the rate of one hundred twenty cubic yards per hour, approximately twenty cubic yards of large, light tailings 118 are discharged per hour from the discharge section 94 of the inner barrel 11, while approximately ninety eight cubic yards of fine light tailings 19 are discharged from the extension 15 of the outer cylindrical drum 12. At least 95% of the ore processed is discharged as tailings 118 and 19 and does not reach the sluice box 150.

The remaining material is carried by the reverse spiral action of the vanes 18 and 20 from right to left, as viewed in FIG. 5, and ejected from the upper end of the outer drum 12 into the trough 146. This discharge from the upper end of the outer drum 12 flows through the trough 146 to the sluice box 150. The fine, heavy material that is carried from the trough 146 falls through the screen 172 into the upper stilling plate 151 of the main channel 168 of the sluice box 150 then travels down the first flight of steps 152–156, where the heaviest of this fine material is entrapped beneath the screens 192 atop the mats 161.

Unlike prior systems, extremely fine particles of gold and other very heavy metals and minerals are entrapped in the main channel 168 of the sluice box 150. The vortex action created by the overhanging lips 160 at each landing, and the vortex action created by the screens 192 aid in this connection. Particulates of gold as small as 500 mesh are consistently trapped in the sluice box 150, and significant quantities of particulates as small as 1300 mesh have been recovered.

The particles of solid material in the trough 146 which are greater in size than 250 mesh cannot drop through the screen 172, but are carried beyond the main channel 168 to the upper end of the bypass channel 169. There the slurry of these larger particles flows down the inclined bypass channel 169 parallel to the upper portion of the main channel 168. The bypass channel 169 joins the main channel 168 at the lower stilling plate 171. By this time virtually all of the very fine particles of gold have been trapped upstream from the lower stilling plate 171 by the steps 152–156.

The flow of the coarser, heavy particles continues down the lower portion of the main channel 168 over the steps 182–188, where the larger, coarser particles of gold are trapped beneath the screens 196 atop the mat sections 161. The less dense, lighter solid material is carried in a slurry and is discharged as a very fine tailing 162, consisting mostly of very fine sand.

The water that is introduced with the ore at the hopper 33 by means of the nozzle 176 not only carries the placer ore in a slurry from the upper to the lower end of the inner barrel 11, but also to a large extent passes radially outwardly through the trommel section 92 into the outer drum 12. There, the flow of a good portion of this water is reversed, as it is carried up the spiral incline by the rotating vanes 18 and 20.

Likewise, the water introduced into the trommel section 92 by means of the spray from the nozzle 137 which is used to wash fine material from heavier rocks and gravel is likewise reused in the outer drum 12. Thus, a considerable portion of the water used in the initial stages for washing the larger rocks and gravel is reused to carry the same material in a slurry into the trough 146. The water is augmented with water from the water lines 125 and 128 to provide sufficient water to carry away the fine tailings through the sluice box 150. Nevertheless, far less water is required to process given quantities of placer ore than is the case with prior devices.

Once the slurry of heavy, fine material is discharged through the screen 172 at the lower end of the trough 146 into the main channel 168 of the sluice box 150, the lighter material is carried downstream and discharged in the fine tailings 162. Meanwhile, tiny flakes of gold settle onto the landings 152–156 beneath the screens 192 and atop the mats 161. Because the fine material is so concentrated by the time it reaches the trough 146, very little water flow is required to carry away sand and other light materials in the light tailings 162. This reduced water flow through the sluice box 150 allows a very, very large portion of the extremely fine gold particulates to settle on the landings 152–156. Indeed, virtually all of the gold having a particle size between 250 mesh and 500 mesh is recovered from the first two landings 152 and 154. The efficiency of gold recovery with the system of the invention is approximately ninety five percent, and the efficiency does not drop as placer ore is processed through the system.

The minimal flow of water through the system also aids in suppressing surging through the sluice. In conventional systems a slurry surge passes through the system with each volume of placer ore introduced into the processing equipment. However, due to the low water consumption and the reversal of direction of the flow of slurry to be processed by the sluice box 150 in the outer drum 12, the sluice box 150 is virtually free of surge effects. Consequently, unlike conventional systems, fine particles of gold are not washed away by surges with the fine tailings 162.

Undoubtedly, numerous variations and modifications of the invention will become readily apparent to those familiar with placer recovery of gold and heavy metals and minerals. It is readily apparent that the various dimensions of the outer drum, the inner barrel, the sections of the inner barrel, and the sluice can all be varied, depending upon the volume of placer ore to be processed. Similarly, the angle of inclination of the axes of the outer drum 12 an the inner drum 13 can be altered to optimize efficiency of recovery from ores of different composition.

Accordingly, the scope of the invention should not be construed as limited to the specific embodiments of the placer recovery apparatus depicted and the implementation of the method described herein, but rather is defined in the claims appended hereto.

I claim:

1. Apparatus for extracting heavy materials from ore comprising:

an annular outer drum mounted for rotation in a disposition inclined relative to horizontal so as to define upper and lower ends thereof with a radially inwardly extending lip at said lower end, and having a cylindrical inner surface with at least one spiral vane mounted thereon to extend between said upper and lower ends, a cylindrical annular inner barrel mounted for rotation in a disposition inclined relative to horizontal and including an upper fragmentation section with inwardly directed, longitudinally oriented impact vanes, an intermediate trommel section delineated from said upper section by an upper inwardly extending annular lip, and a lower discharge section delineated from said trommel section by an inwardly directed intermediate annular lip and having an inwardly directed lower annular lip at its lower extremity, a sluice box located to receive as an input, material discharged from said upper end of said outer drum, means for directing a spray of water into said trommel section of said inner barrel, means for supplying a flow of water to said sluice box, and drive means for rotating said outer drum at a first speed so that said spiral vane urges material therein toward said upper end thereof, and for rotating said inner barrel at a second speed greater than said first speed.

2. Apparatus according to claim 1 further comprising a plurality of spiral vanes in said outer drum as aforesaid all having the same pitch and oriented at equal arcuate displacements relative to each other.

3. Apparatus according to claim 1 further characterized in that said drum is inclined at an angle of between about two degrees and about fifteen degrees relative to horizontal.

4. Apparatus according to claim 3 wherein said drum is inclined at an angle of about eight degrees relative to horizontal.

5. Apparatus according to claim 3 further characterized in that said drive means rotates said outer drum at a speed of between about one and ten revolutions per minute.

6. Apparatus according to claim 3 further comprising a means for supplying water to said outer drum throughout its cylindrical inner surface disposed between said inner barrel and said outer drum, and wherein said outer drum is further comprised of a longitudinally extending annular extension located on said radially extending lip of said outer drum and having at least one radially directed spiral vane extending inwardly therefrom.

7. Apparatus according to claim 1 further characterized in that said inner barrel is concentrically mounted relative to said outer drum.

8. Apparatus according to claim 7 further characterized in that said trommel section is provided with a multiplicity of fine perforations at its upper end and a multiplicity of coarse perforations at its lower end.

9. Apparatus according to claim 8 wherein said fine perforations are about one quarter inch in diameter and said coarse perforations are about one and three quarters inches in diameter.

10. Apparatus according to claim 1 wherein said inner barrel is inclined at an angle of between about two degrees and about fifteen degrees relative to horizontal.

11. Apparatus according to claim 10 wherein said inner barrel is inclined at an angle of abou' eight degrees relative to horizontal.

12. Apparatus according to claim 10 further characterized in that said drive means rotates said inner barrel at a speed of between about twenty and thirty revolutions per minute.

13. Apparatus according to claim 1 further comprising a supporting frame and wherein said outer drum and said inner barrel are mounted in coaxial alignment on said supporting frame and further comprising vibrating means interposed between said supporting frame and said outer drum to impart vibrations to said outer drum.

14. Apparatus according to claim 1 wherein said outer drum and said inner barrel are mounted on a mobile supporting chassis.

15. Apparatus according to claim 1 wherein said sluice box is comprised of a plurality of vertically offset landings, whereby material flowing through said sluice box cascades downwardly from each landing to the landing below.

16. Apparatus according to claim 15 wherein each landing above the lowermost landing terminates in a lip that overhangs the landing below.

17. Apparatus according to claim 15 wherein said landings are divided into upper and lower flights in said sluice box, and said sluice box is comprised of a main channel containing both said upper and lower flights, a screen located between said upper end of said outer drum and said main channel, and a bypass channel forming a channel parallel to said portion of said main channel containing said upper flight of landings and intersecting said main channel between said upper and lower flights of landings therein and disposed to receive material from said upper end of said outer drum which cannot pass through said screen.

18. Apparatus for recovering heavy substances from raw material comprising:

(a) an outer hollow drum mounted at an inclination relative to horizontal so as to define upper and lower ends thereof and having a radially inwardly directed lip at its lower extremity and having an inner cylindrical wall with vane means mounted thereon that extends in a helical spiral on said inner cylindrical wall between said upper and lower ends of said drum;

(b) an inner hollow barrel mounted within said drum inclined relative to horizontal and having an upper section with an annular cylindrical wall having a plurality of impact vanes extending inwardly therefrom and aligned longitudinally therealong, an intermediate section coaxial with said upper section and delineated therefrom at a radially inwardly extending upper annular lip and having an annular cylindrical wall with a multiplicity of openings therein whereby said intermediate section serves as a trommel, and a lower section coaxial with and delineated from said intermediate section by a radially inwardly extending intermediate annular lip and having a solid cylindrical annular wall with a radially inwardly extending lower annular lip at its lower extremity;

(c) a sluice box positioned so as to receive discharge from the upper end of said outer drum;

(d) means for directing a spray of water toward said intermediate section of said inner barrel;

(e) means for supplying a flow of water to said sluice box;

(f) means for rotating said outer drum at a first speed in a direction such that said spiral vane means urges material within said drum toward said upper end thereof; and (g) means for rotating said inner barrel at a speed greater than said speed of said outer drum.

19. Apparatus according to claim 18 wherein said spiral vane means is comprised of a plurality of spiral vanes of uniform pitch angularly offset from each other by equal arcuate distances.

20. Apparatus according to claim 18 further comprising a means for spraying water along the length of said inner cylindrical wall of said outer drum and a frustoconical extension extending longitudinally from said lip at said lower extremity of said drum and including at least one spiral vane mounted on said extension and extending radially inwardly therefrom.

21. Apparatus according to claim 18 further characterized in that said annular cylindrical wall of said intermediate section is perforated with openings of a size of between one-quarter to one and three-quarters of an inch across.

22. Apparatus according to claim 18 further comprising means for vibrating said outer drum.

23. Apparatus according to claim 18 further comprising a mobile supporting chassis for supporting said outer drum and said inner barrel to rotate about a common axis.

24. Apparatus according to claim 23 further comprising a floating support, a pair of guide rollers mounted on said floating support and bearing against the underside of said rotating drum, and resilient spring means interposed between said floating support and said mobile supporting frame, and means for vibrating said floating support.

25. Apparatus according to claim 23 wherein said sluice box is formed with a series of vertically offset steps arranged in a cascade.

26. Apparatus according to claim 25 wherein said sluice box has a main channel with upper and lower portions and wherein said vertically offset steps are located in said main channel and are separated into upper and lower flights respectively located in said upper and lower portions of said main channel, and said sluice box is further comprised of a bypass channel forming a flow path parallel to said upper portion of said main channel and intersecting said main channel between said upper and lower portions thereof, and a screen means interposed between said upper end of said outer drum and said upper portion of said main channel to separate discharge from said upper end of said outer drum into a portion containing fine particles which flows into said upper end of said outer drum and a portion containing coarse particles which flows through said bypass channel and into said lower portion of said main channel.

27. Apparatus according to claim 25 wherein each step is comprised of a landing and a lip overhanging said landing.

28. A process for separating heavy materials from ore using an outer hollow cylindrical annular drum inclined relative to horizontal to define upper and lower ends and having at least one spiral vane extending inwardly from its inner wall and a radially inwardly extending lip at said lower end, a cylindrical annular barrel located within said drum and inclined relative to horizontal and having an upper fragmentation section, an intermediate trommel section, and a lower discharge section delineated from each other by inwardly directed annular lips and having a radially inwardly extending lip at its lower extremity, and a sluice box having upper and lower ends, comprising the steps of:

rotating said outer drum at a first speed in a direction such that said spiral vane urges material therein toward said upper end of said outer drum and toward said upper end of said sluice box, rotating said inner barrel at a second speed greater than said first speed, directing discharge from said upper end of said drum as an input into said sluice box, and directing a spray of water into said trommel section of said inner barrel.

29. A process according to claim 28 further comprising directing water onto said inner wall of said outer drum.

30. A process according to claim 29 further comprising rotating said outer drum at a speed of between about four and eight revolutions per minute and said inner barrel at a speed of between about twenty four and twenty eight revolutions per minute.

31. A process according to claim 30 further comprising applying vibrations to said outer drum.

32. A process according to claim 31 further comprising supplying a flow of water to said sluice box and further comprising supplying ore to said cylindrical annular barrel at a rate of between about one half cubic yard per hour and about three hundred cubic yards per hour and directing a combined flow of water into said outer drum, said inner barrel and into said sluice box at a rate less than five hundred gallons per minute.

33. A process according to claim 29 further comprising screening said discharge from said upper end of said drum to separate coarse solids from fine solids, passing said fine solids directly into said upper end of said sluice box, and passing said coarse solids into said sluice box at a point below said upper end thereof.

34. A process according to claim 29 further comprising screening said discharge from said upper end of said drum to separate solids therein into a discharge portion containing entrained fine particles and a discharge portion containing entrained coarser particles and passing said discharge portion containing fine particles into said upper end of said sluice box and introducing said discharge portion containing said coarser particles into said sluice box downstream from said upper end thereof, whereby said coarser particles bypass said upper end of said sluice box.

* * * * *